United States Patent [19]

Mikami et al.

[11] Patent Number: 4,706,795

[45] Date of Patent: Nov. 17, 1987

[54] COIN DISCRIMINATOR

[75] Inventors: Mitsugu Mikami, Kawagoe; Kougi Yukimoto, Sakado; Jun Ishii, Kawagoe, all of Japan

[73] Assignee: Kabushiki Kaisha Nipponcoinco, Tokyo, Japan

[21] Appl. No.: 809,491

[22] Filed: Dec. 16, 1985

[30] Foreign Application Priority Data

Dec. 18, 1984 [JP] Japan ..... 59-265199

[51] Int. Cl.[4] ..... G07D 5/02; G07D 5/08

[52] U.S. Cl. ..... 194/317; 194/321; 194/335; 194/336; 194/345

[58] Field of Search ..... 133/3 C, 3 E, 3 R; 194/317, 321, 325, 335, 336, 345, 344

[56] References Cited

U.S. PATENT DOCUMENTS

| | | | |
|---|---|---|---|
| 2,277,018 | 3/1942 | Patzer et al. | 194/345 X |
| 2,446,510 | 8/1948 | Hokanson | 194/325 X |
| 2,545,426 | 3/1951 | Hokanson | 194/336 |
| 2,569,603 | 10/1951 | Gottfried | 194/336 X |
| 3,155,214 | 11/1964 | Haverstick | 194/336 |
| 3,163,278 | 12/1964 | Rounsivell | 194/345 X |
| 3,197,009 | 7/1965 | Okolischan | 194/336 X |
| 3,382,962 | 5/1968 | Nielsen | 194/345 |
| 3,722,653 | 3/1973 | Hennessy | 194/336 X |
| 4,106,608 | 8/1978 | Dietz | 194/345 |
| 4,234,072 | 11/1980 | Prümm | 194/317 |
| 4,376,480 | 3/1983 | Abe | 194/336 X |
| 4,576,275 | 3/1986 | Kobayashi et al. | 194/203 |

FOREIGN PATENT DOCUMENTS

| | | | |
|---|---|---|---|
| 232225 | 12/1959 | Australia | 194/335 |
| 611123 | 12/1960 | Canada | 194/336 |
| 2744945 | 4/1979 | Fed. Rep. of Germany | 194/345 |
| 615105 | 8/1947 | United Kingdom | 194/335 |
| 925094 | 5/1963 | United Kingdom | 194/321 |
| 1419456 | 12/1975 | United Kingdom | 194/325 |
| 2039684 | 8/1980 | United Kingdom | 194/345 |

*Primary Examiner*—Robert J. Spar
*Assistant Examiner*—P. McCoy Smith
*Attorney, Agent, or Firm*—Koda and Androlia

[57] ABSTRACT

A coin discriminator for discriminating good coins from bad coins among a plurality of different types of coins and sorting the coins by denomination has a cradle for selecting the coins in accordance with their diameter, and a swing lever which is urged in a direction toward the space between the two ends of the cradle. The swing lever biases a small coin so as to cause it to pass the space between the two ends of the cradle. A large coin urges the swing lever and is removed from the cradle.

6 Claims, 5 Drawing Figures

COIN DISCRIMINATOR

BACKGROUND OF THE INVENTION

The present invention relates to a coin discriminator used in an automatic vending machine or the like and, more particularly, to a coin discriminator which can discriminate a plurality of different types of coins without error.

Various types of coin discriminators have been developed to discriminate good coins from bad coins as well as types of coins in accordance with diameter, thickness, and material. Many conventional coin discriminators use cradles to discriminate coin diameter. In discriminating coins by the use of discriminators of this kind, a small coin can pass through a space between two ends of the cradle and is guided to one coin passage. However, a large coin cannot pass between the two ends of the cradle. The cradle is then pivoted to guide the large coin to the other coin passage. In conventional coin discriminators, small coins are sometimes mistakenly stopped by the cradle. The cradle is then pivoted, and the small coin is erroneously guided to an incorrect coin passage.

Since water, dust, oil and the like can build up in a coin passage and impair smooth coin flow, the coin passage must be periodically cleaned. For this reason, the gate constituting the coin passage can be freely opened/closed, as is known to those skilled in the art. According to another known gate assembly, when a customer turns a return lever in an automatic vending machine or the like, the gate is opened to dispense coins caught between the gate and a main plate.

SUMMARY OF THE INVENTION

It is an object of the present invention to provide a new and improved coin discriminator capable of discriminating good coins from bad ones among a plurality of different types of coins and of sorting the different types of coins, wherein the above-mentioned erroneous cradle operation can be prevented.

It is another object of the present invention to provide a coin discriminator wherein oil and dust built up in the coin passage can be easily removed.

It is still another object of the present invention to provide a coin discriminator which can smoothly dispense coins or other objects caught along the coin passage.

According to the present invention, there is provided a coin discriminator for discriminating good coins from bad coins among a plurality of different types of coins and for sorting the different types of good coins by denomination, characterized by a cradle for selecting coins in accordance with coin diameter, and a swing lever biased toward the space between the two ends of the cradle, the swing lever allowing a small coin to pass between the two ends of the cradle and being pushed away by a large coin which is then removed from the cradle.

Preferably, the coin discriminator has a transfer lever for guiding a coin from a front coin passage of a main plate to a rear coin passage thereof, a rear gate mounted on the main plate in the rear coin passage which pivots about a pivot pin, a spring mounted on the pivot pin to bias a rear gate stop pivotally mounted about the pivot pin toward one axial direction of the pivot pin and to bias the rear gate and the rear gate stop in opposite directions, the rear gate stop being engaged with a hole formed in the main plate when the rear gate stop is moved against the biasing force of the spring in the other direction, and the rear gate stop and the rear gate being pivotal about the pivot pin.

More preferably, the gate lever operated for coin return has a tapered projection, the gate pivotally mounted on the main plate to form a predetermined gap which constitutes a coin passage has a roller engaged with the tapered projection, and the tapered projection separates the gate from the main plate through the roller to open the coin passage.

Such a coin discriminator has the following advantage. When coins are discriminated by the cradle in accordance with coin diameter or the like, the swing lever is arranged to prevent small coins, which should pass through a space between protrusions formed on opposite ends of the cradle to drop therefrom, erroneously stopped at one end of the cradle from being guided to the wrong coin passage. Small coins erroneously stopped by the cradle are forcibly pushed between the two ends of the cradle, and thus pass through the cradle. Large coins, however, push away the swing lever and are guided along the proper coin passage, thereby improving the discrimination function of the cradle.

Further, to perform cleaning the coin passage, for instance, the rear gate of the present invention is held by the rear gate stopper in an open position. Furthermore, when the rear gate is closed, it is securely held in the closed position. This facilitates cleaning of the coin passage.

When the gate lever is actuated, the tapered projection on the gate lever is engaged with the roller pivotally mounted on the gate, and the roller rolls to separate the gate from the main plate through the tapered projection, thereby decreasing friction between the gate and the main plate. Unlike conventional gate mechanisms wherein the tapered projection on the gate lever directly pushes the end of the gate upward, excessive force need not be used. Thus the customer can turn the return lever of an automatic vending machine or the like with a minimum of force. Even a child can turn the lever.

DETAILED DESCRIPTION OF THE PREFERRED EMBODIMENT

Figure 1:
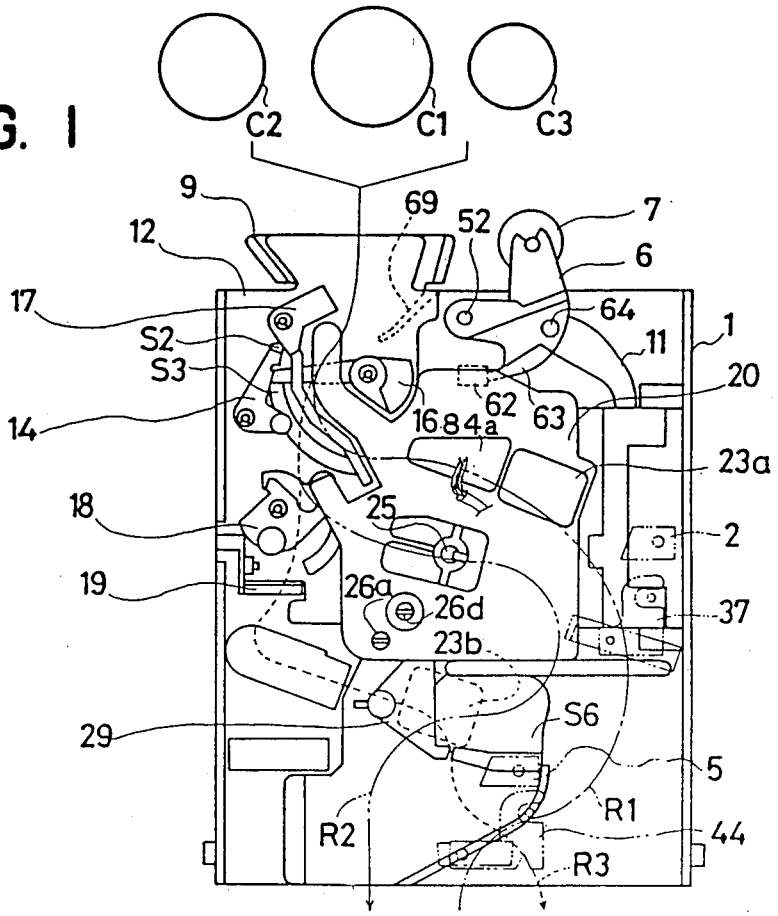
FIG. 1 is a front view showing a coin discriminator according to an embodiment of the present invention when a front cover thereof is removed.
Figure 2:
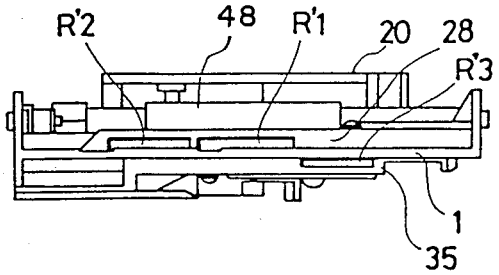
FIG. 2 is a bottom view of the coin discriminator shown in FIG. 1.
Figure 3:
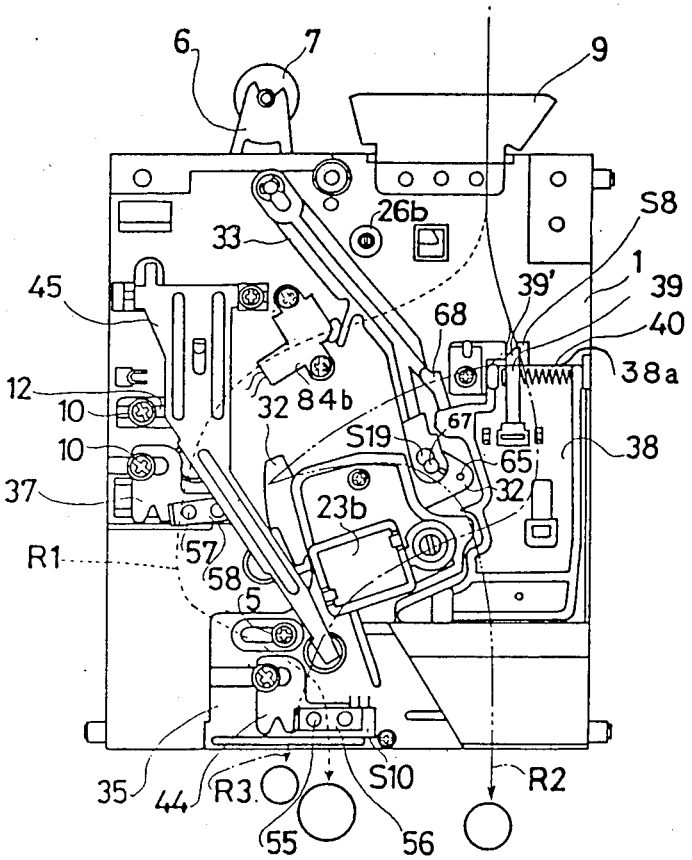
FIG. 3 is a rear view of the coin discriminator shown in FIG. 1.
Figure 4:
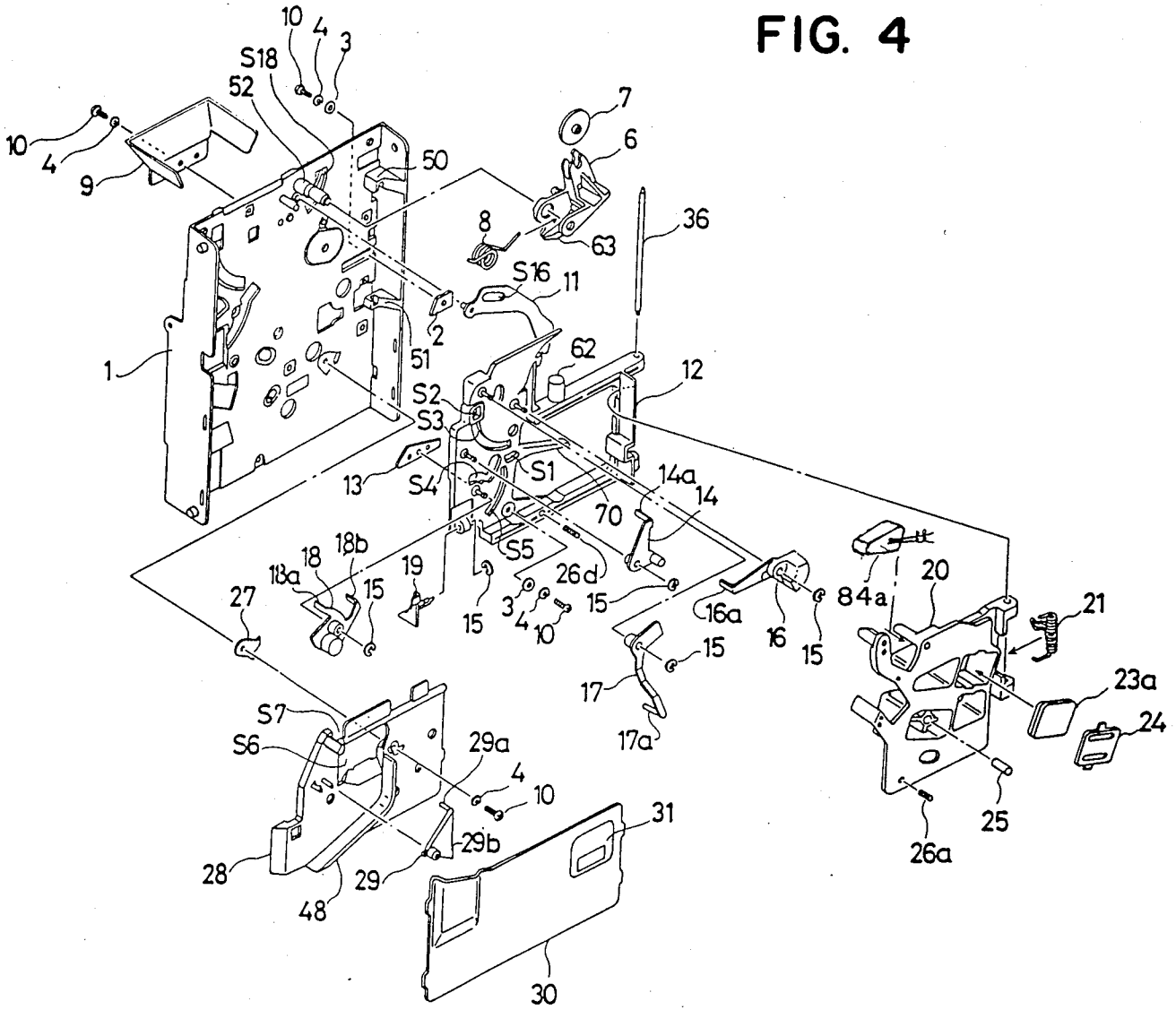
FIG. 4 is a partial exploded perspective view showing the front-side construction of the coin discriminator shown in FIG. 1.
Figure 5:
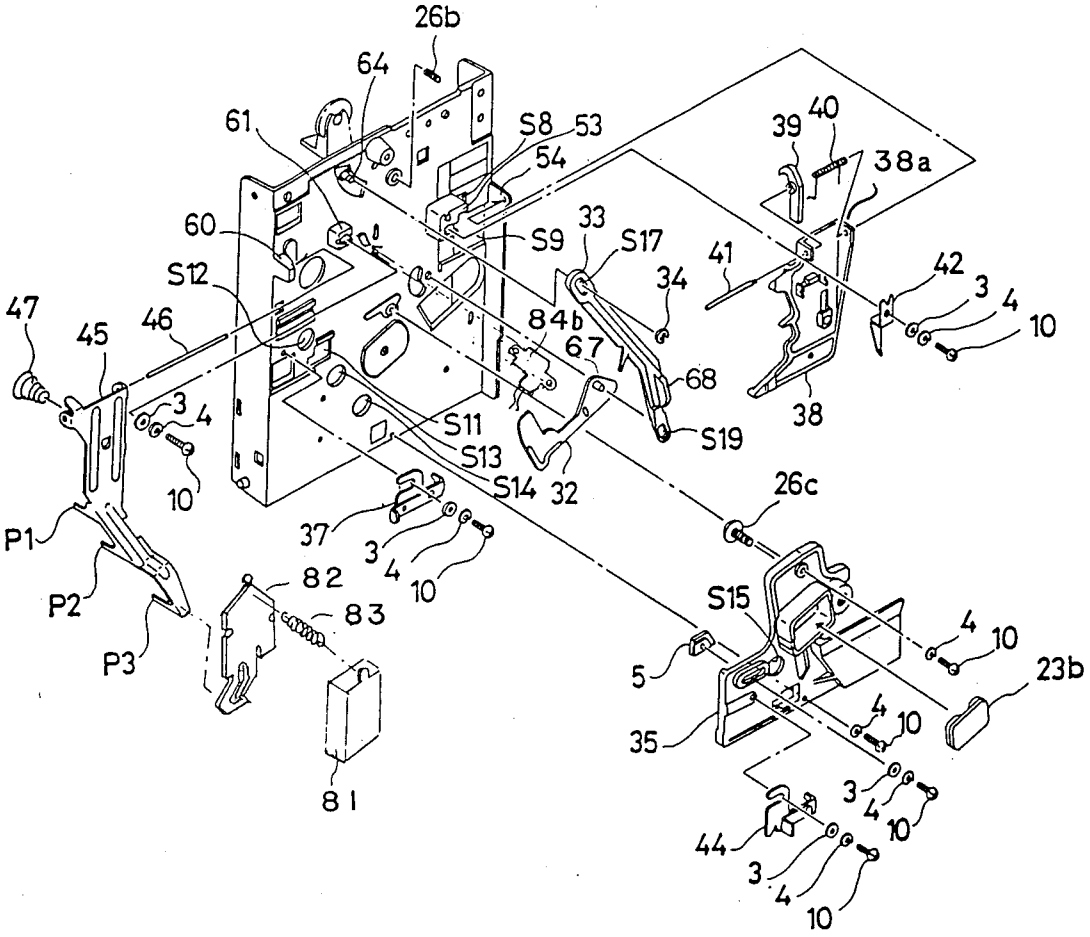
FIG. 5 is a partial exploded perspective view showing the rear-side construction of the coin discriminator shown in FIG. 1.

A preferred embodiment of the present invention will be described with reference to the accompanying drawings FIGS. 1 to 5 show a coin discriminator according to an embodiment of the present invention. A gate 12 and a magnetic gate 20 are pivotally mounted on a gate pivot pin 36 supported by bearings 50 and 51 on a main plate 1. A gate spring 21 presses the gate 12 and the magnetic gate 20 toward the main plate 1 (FIG. 4). Gaps are defined by the main plate 1, the gate 12, and the magnetic gate 20 to constitute coin passages R1, R2 and R3. A chute 28 is mounted at the lower portion of the main plate 1. As shown in FIGS. 3 and 5, a rear gate 38 is pivotally mounted on a pivot pin 41 on the rear surface of the main plate 1 and is urged by a rear gate spring 40 toward the main plate 1. A magnet bracket 35 is mounted at the lower portion of the rear surface of the main plate 1. Gaps are formed between the main plate 1, the chute 28, the rear gate 38, and the magnet bracket 35 to constitute coin passages. A funnel 9 is fixed by a screw 10 to the main plate 1 to guide a coin loaded in an automatic vending machine or the like. Reference numeral 4 denotes a spring washer.

A first swing lever 17 is pivotally mounted on the gate 12. A tip 17*a* of the first swing lever 17 extends into the coin passage through a hole S1 (FIG. 4). The lever 17 is normally balanced in the state shown in FIG. 1. A second swing lever 14 is pivotally mounted on the gate 12, and its tip 14*a* extends into the coin passage through a hole S2 formed in the gate 12. Similarly, a carrier arm 16 is pivotally mounted on the gate 12, and a tip 16*a* of the carrier arm 16 extends into the coin passage through a hole S3 formed in the gate 12. A cradle 18 is pivotally, mounted on the gate 12, and tips 18*a* and 18*b* of the cradle 18 extend into the coin passage through holes S4 and S5 formed in the gate 12. The first swing lever 17, the second swing lever 14, the carrier arm 16, and the cradle 18 are provided with balancers (not shown), for instance, to be normally located at the positions shown in FIG. 1. A transfer lever 19 is pivotally mounted on the gate 12. The tip of the transfer lever 19 always extends into the gate 12 due to its weight, and it guides inserted coins to a rear coin passage defined by the rear gate 38 and the main plate 1.

A magnet 23*a*, a pole magnet 25, and a coil 84*a* of an electronic discriminator are mounted on the magnetic gate 20. Reference numeral 24 denotes a magnet cover on which the magnet 23*a* is mounted.

A lever 29 is pivotally mounted on the chute 28, and tips 29*a* and 29*b* of the lever 29 extend into the coin passage through a hole S6 and a notched portion S7 formed in the chute 28. A first string cutter 27 is fixed by a screw 10 to a surface defining the coin passage.

The rear gate 38 is mounted on the pivot pin 41 on the rear surface of the main plate 1. The pivot pin 41 is pivotally mounted on pivot portions 53 and 54. The rear gate spring 40 and the rear gate stop 39 are mounted on the pivot pin 41. The spring 40 biases the rear gate 38 toward the main plate 1 and biases a tip 39' of the rear gate stop 39 toward the main plate 1. The spring has two legs, one engaging the front of the rear gate, and one engaging the lower back side of the rear gate stop. The tip 39' of the rear gate stop 39 is tapered and the top 39' is urged by the biasing force of the spring 40 toward a hold S8 formed in the main plate 1. In order to open the rear gate 38, the rear gate stop 39 is moved to the right in FIG. 3 while the spring 40 is being compressed. The tip 39' of the rear gate stop 39 engages the hole S8 and enters therein. The rear gate stop 39 is also biased into contact with the upper end portion 38*a* of the rear gate 38 by the spring 40. In this state, when the rear gate stop 39 or the rear gate 38 is moved upward with respect to the drawing surface in FIG. 3, the rear gate stop 39 enters the hole S8, and the rear gate 38 is opened. A second string cutter 42 is fixed by a screw 10 or the like to the rear surface of the main plate 1. A break is formed at the distal end portion of the string cutter 42. One distal end portion defined by the break is bent downward at the edge of a hole S9 for guiding a coin from the front side to the rear side of the main plate 1. The other distal end portion defined by the break in the string cutter 42 is bent upward (i.e., the rear gate side). When a coin attached to a string is about to be removed by pulling the string upward, the string is cut by the blade. A coil 84*b* of an electronic discriminator is mounted on the rear surface of the main plate 1 to oppose the coil 84*a*. The magnet bracket 35 is fixed on the rear surface of the main plate 1. A magnet 23*b* is mounted on the magnet bracket 35. A second deflector 5 is fixed by the screw 10 such that the position of the former can be adjusted with respect to the coin passage surface. A second separator 44 is fixed by a screw 10 such that the position of the former can be adjusted. A separator member 56 pivotally mounted on a pin 55 extends over the coin passage surface through a hole S10 formed in the magnet bracket 35. A first separator 37 is mounted by a screw 10 on the rear surface of the main plate 1 such that the position of the main plate 1 can be adjusted. A separator member 58 pivotally mounted on a pin 57 extends into the coin passage through a hole S11 formed in the main plate 1. A first deflector 2 is fixed by a screw 10 such that the position of the former can be adjusted with respect to the front-side coin passage of the main plate 1. A C.R.E.M. extension 45 pivotally mounted on a shaft 46 supported by bearings 60 and 61 is biased by a spring 47 away from the main plate 1. The spring 47 is fixed to the rear surface of the main plate 1. An actuator 82 has an upper end coupled to the upper end of an electromagnet 81 through a torsion spring 83, and is pivotally supported at its opposite upper side edges by a main housing to which the coin discriminator is mounted. When the power of an automatic vending machine incorporating the coin discriminator is turned on, the actuator 82 is turned on. The actuator 82 is magnetically attracted to the electromagnet 81 and is separated from the C.R.E.M. extension 45. However, when the electromagnet 81 is deenergized, the actuator 82 is forced by the spring 83 toward the C.R.E.M. extension 45 and its lower end presses against the C.R.E.M. extension 45. Projections P1 to P3 formed on the C.R.E.M. extension 45 are respectively inserted in holes S12, S13, and S14 formed in the main plate 1 and extend into the coin path through a hole S15 formed in the magnet bracket 35. The inserted coin is automatically returned. A gate lever 6 is pivotally mounted on a pin 52 on the main plate 1 and is biased by a spring 8 counterclockwise in FIG. 1. A gate lever roller 7 is pivotally mounted on the gate lever 6 and has a tapered projection 63 which is engaged with a roller 62 pivotally mounted on the gate 12 and which separates the gate 12 from the main plate 1. A pin 64 is fixed on the gate lever 6, and the pin 64 extends through a hole S18 formed in the main plate 1. At the front side of the main plate 1, the pin 64 is engaged at one end with a hole S16 formed in a front wiper 11, which is pivotally engaged with the main plate 1. At the rear side of the main plate 1, the pin 64 is engaged with a hole S17 formed in a wiper actuator 33. The distal portion of the wiper actuator 33 has a hole S19, which receives a pin 67 formed on a rear wiper 32 pivotally mounted on a pin 65 on the main plate 1. The distal portion of the wiper actuator 33 has a tapered projection 68 and is engaged with the rear gate 38.

When the return lever in the automatic vending machine or the like is turned and the gate lever 6 is actuated, the tapered projection 63 is engaged with the roller 62 to separate the gate 12 from the main plate 1. At the same time, the front wiper 11, the wiper actuator 33, and the rear wiper 32 are actuated, and the rear gate 38 is opened, thereby dispensing the coin caught along the coin passage. A thickness screw 26*a* is provided in the magnetic gate 20 so as to extend toward the main plate 1. A thickness screw 26*b* is provided in the main plate 1 to extend from the rear surface to the front surface of the main plate 1. A gap between the main plate 1 and the magnetic gate 20 can be adjusted by the thickness screws 26*a* and 26*b*. A bad coin having a large thickness is blocked by the gap between the main plate 1 and the magnetic gate 20. A thickness screw 26*c* is mounted on the magnet bracket 35. A coin having a large thickness is blocked due to a small gap between the thickness screw 26*c* and the main plate 1. Reference numerals 13 and 70 denote rails, respectively.

The operation of the coin discriminator according to this embodiment will now be described.

The coin discriminator discriminates three types of coins C1, C2 and C3 having different diameters. When the coin C1 of the largest diameter is inserted, the coin C1 is guided by a guide member 69 of the gate 12 which is located opposite to the funnel 9, and is placed on the tip 16*a* of the carrier arm 16 which extends in the coin passage. The carrier arm 16 is pivoted due to its own weight about the pivot point along the hole S3 and is guided onto the coin rail 70. The coin C1 is placed on and then drops from the coin rail 70. Meanwhile, the coin C1 is discriminated by coils 84*a* and 84*b* of the electronic discriminator and receives the influence of the magnet 23*a*. When the coin C1 is detected as a good coin, it abuts against the first deflector 2 and passes between the first separator 37 and the first deflector 2. The coin C1 is then guided to a coin exit R1' (FIG. 2). Referring to FIG. 1, the coin C1 flows along the coin passage R1 and is discriminated. However, when the coin diameter is larger than that of the coin C1, the coin is stopped at an entrance of the coin passage formed between the main plate 1 and the gate 12 or at the guide member 69 arranged between the carrier arm 16 and the gate 12. However, when the coin diameter is smaller than that of the coin C1, the coin is not placed on the tip 16*a* of the carrier arm 16 but is guided to the discrimination passages R2 and R3 for smaller coins. When a coin thickness is larger than that defined by the gap between the main plate 1 and the magnetic gate 20 and adjusted by the thickness screws 26*a* and 26*b*, the coin cannot drop between the main plate 1 and the magnetic gate 20. When a coin material is different from that of the authentic coin, the coin receives the influence of the magnet 23*a* and rebounds against the first deflector 2 or abuts against the first separator 37. As a result, such a bad coin cannot drop between the first deflector 2 and the first separator 37 and passes through the hole S6 formed in the chute 28. The bad coin is guided by a guide 48 to a return passage. When the electronic discriminator causes the coils 84*a* and 84*b* to detect that the inserted coin is a bad coin, the electromagnet 81 is turned off, and the actuator 82 is extended by the biasing force of the spring 83, so that the projection P1 of the C.R.E.M. extension 45 extends into the coin passage R1. As a result, the bad coin is guided in the return passage.

The coin C2 having an intermediate diameter passes through the carrier arm 16 and is placed on tips 18*a* and 18*b* of the cradle 18. The cradle 18 is rotated clockwise (FIG. 1) by the weight of the coin C2. The coin C2 urges the tip 17*a* of the first swing lever 17 and is guided to the coin rail 13. The coin C2 receives the influence of the pole magnet 25 and abuts against the first separator 37. The coin C2 passes between the tips 29*a* and 29*b* of the lever 29 due to a reaction force from the separator 37 and is guided to a coin exit R2' (FIG. 2). In other words, the coin C2 passes through the coin passage R2. However, when a coin has a diameter larger than that of the coin C2, such a coin is placed on two ends 18*a* and 18*b* of the cradle 18 and is stopped by the guide member 69 projecting from the gate 12 constituting the coin passage R2 while the coin is guided to the coin passage R2. When a coin has a thickness larger than that defined by the gap between the main plate 1 and the magnetic gate 20, the coin is clamped and stopped therebetween. However, when a coin has a thickness smaller than that defined by the gap, the coin drops from the rail 13 (FIG. 4) and abuts against a projecting portion of a thickness screw 26*d* located at the rail 13 side with respect to gate 12. The coin is then guided to the return passage. When a coin material is different from that of the coin C2, the reaction force of the separator 37 obtained by the pole magnet 25 is changed, and the coin cannot pass between the tips 29*a* and 29*b* of the lever 29. The coin passes through the hole S6 toward the chute 28 and is guided by the guide 48 to the return passage.

The coin C3 having a smallest diameter passes through the carrier arm 16 and then between the tips 18*a* and 18*b* of the cradle 18. In order to prevent the coin C3 from being placed on the tip 18*b* of the cradle 18 and the cradle 18 from being rotated to guide the smallest coin C3 to the coin passage R2 of the intermediate coin C2, the first swing lever 17 urges the coin C3 between the tips 18*a* and 18*b* of the cradle 18. Therefore, the coin C3 can properly pass between the tips 18*a* and 18*b* of the cradle 18. The coin C3 is guided by the transfer lever 19 to the side of the rear gate 38, i.e., the rear-side coin passage of the main plate 1. The coin C3 receives the influence of the magnet 23*b* mounted on the magnet bracket 35 and abuts against the second deflector 5. The coin C3 then passes between the second deflector 5 and the second separator 44 and is guided to a coin exit R3'. A coin having a thickness larger than that of the good coin is clamped between the main plate 1 and the thickness screw 26*c* mounted in the magnet bracket 35 and will not drop. When a coin has a material different from that of the coin C3, such a coin receives the influence of the magnet 23*b* and cannot pass between the second deflector 5 and the second separator 44. The coin is thus guided to the return passage. A coin having a diameter smaller than that of the good coin C3 cannot pass between the second deflector 5 and the second separator 44, and is also guided to the return passage.

The operation of the coin discriminator has thus been described above. When a coin is caught along the coin passage R1, R2 or R3, the customer turns the return lever in the automatic vending machine or the like and the gate lever 6 is pressed. The gate lever 6 is pivoted about the pin 52 clockwise in FIG. 1. The tapered projection 63 on the gate lever 6 pushes the gate 12 upward through the roller 62, and the gate 12 is rotated about the pin 36 against the biasing force of the spring 21. The gate 12 is separated from the main plate 1 to widely open the coin passage R1, R2 and R3. When the gate lever 6 is further pivoted, the pin 64 on the gate lever 6 causes the front wiper 11 and the wiper actuator 33 to operate. The front wiper 11 is rotated clockwise in FIG. 1. A coin caught between the main plate 1 and the gate 12 and the magnetic gate 20 is returned. When the wiper actuator 33 is urged by the pin 64 and is moved in the lower right direction in FIG. 3, the tapered projection 68 on the distal portion of the wiper actuator 33 moves the rear gate 38 upward. The rear gate 38 is separated from the main plate 1 against the biasing force of the spring 40, thereby opening the coin passage. The rear wiper 32 mounted through the hole S19 of the wiper actuator 33 and the pin 67 is pivoted about the pin 65 counterclockwise. The coin caught between the main plate 1 and the magnet bracket 35 is dispensed and returned.

When the electromagnet 81 is turned off due to a power failure or an OFF switching of the automatic vending machine, the magnetic attracting force of the electromagnet 81 disappears. Then, the actuator 82 biased toward the C.R.E.M. extension 45 by the spring 83 presses the C.R.E.M. extension 45 against the spring 47. The projections P1, P2 and P3 formed on the C.R.E.M. extension 45 extend in the coin passage through the holes S12, S13 and S14 formed in the main plate 1 and the magnet bracket 35, thus returning the inserted coin through the coin return passage. When the inserted coin is detected as a bad coin by an electronic discriminator 84 inserted and screwed in a recess of the magnetic gate 20, the electromagnet 81 is deenergized and the bad coin is returned through the return passage.

When the coin discriminator is used for a long period of time, foreign materials such as dust, oil and water are built up in the coin passages, and discrimination efficiency is degraded. The coin passages must therefore be cleaned periodically. When the coin passage between the main plate 1 and the gates 12 and 20 is cleaned, the gate 12 is pulled (upward with respect to the drawing surface in FIG. 1) about the pin 36 against the biasing force of the spring 21. In other words, the gates 12 and 20 are separated from the main plate 1, and the main plate 1, the gate 12, the magnetic gate 20, and the coin passage surfaces are cleaned. When the coin passage of the rear gate 38 portion is cleaned, the rear gate stop 39 is moved to the right against the biasing force of the spring 40 in FIG. 3. The tip 39' of the rear gate stop 39 is engaged with the hole S8 formed in the main plate 1 and held there. For this reason, the rear gate stop 39 and the rear gate 38 can be rotated about the pivot pin 41 in FIG. 3. When the rear gate 38 or the lower portion of the rear gate stop 39 is pulled, the rear gate 38 is opened and can be rotated through about 180° and held in the rotated position. The coin passage of the rear gate 38 portion can be easily performed. When cleaning is completed, the rear gate 38 is closed and the lower portion of thc rear gate stop 39 is pressed. The tip 39' of the rear gate stop 39 is then disengaged from the hole S8 and is moved to the left (FIG. 3) by the spring 40. As a result, the rear gate 38 can be held in the closed state.

In the above embodiment, the coils **84*a* and 84*b* of the electronic discriminator are arranged in the coin passage (R1) to discriminate authenticity of the coins. When an inserted coin is detected as a bad coin, the electromagnet 81 is deenergized to allow the projection of the C.R.E.M. extension 45** extend into the coin passage to return the bad coin. However, the electronic discriminator need not be used. The coin discriminator can discriminate coins with/without an electronic discriminator. When the electronic discriminator is used, coin discrimination precision :s improved. In this sense, whether to use an electronic discriminator or not can be determined in accordance with each application.

What is claimed is:

1. A coin discriminator for discriminating good coins from bad coins among a plurality of different types of coins and sorting the coins by denomination, comprising:

a transfer lever for guiding the different types of coins from a front coin passage of a main plate to a rear coin passage thereof;

a rear gate mounted in said rear coin passage and pivotal about a pivot pin mounted on said main plate;

a rear gate stop pivotal about said pivot pin;

a spring fittedly mounted on said pivot pin for biasing said rear gate stop axially of said pivot pin and for biasing said rear gate and said rear gate stop in opposite directions from each other circumferentially of said pivot pin, said rear gate stop being engaged with a hole formed in said main plate, when said rear gate stop is moved against the axial biasing force of said spring;

a cradle for selecting the coins in accordance with diameters of the coins; and a swing lever swingable towards a space between two ends of said cradle, said swing lever adapted to be urged so that a small coin having a diamete smaller than a distance between said two ends of said cradle to pass between said two ends, and adapted to be pushed away by a large coin to allow said large coin to be removed from said cradle.

2. A discriminator according to claim 1, wherein a coil of an electronic discriminator is arranged in a coin discriminator passage defined in said discriminator to electronically discriminate the coins.

3. A discriminator according to claim 1, further comprising: a gate lever actuated at the time of coin return and having a tapered projection; and a gate pivotally mounted, and defining a gap constituting a coin return passage between itself and said main plate, and having a roller engaged with said tapered projection of said gate lever, said tapered projection being adapted to separate said gate from said main plate through said roller when said gate lever is being actuated.

4. A discriminator according to claim 3, further comprising a front wiper plate pivotally mounted on a pin on said main plate, a pin extending on said gate lever being engaged with a hole formed in said front wiper plate, and said front wiper plate being pivoted in the coin return passage defined by said gate and said main plate through said pin extending on said gate lever upon actuation of said gate lever, thereby dispensing a coin caught between said gate and said main plate.

5. A discriminator according to claim 3, wherein a pin on said gate lever extends through a hole formed in said main plate and is engaged with a hole formed at one end portion of a wiper actuator slidably mounted on a rear surface of said main plate, and said rear gate is moved upward by a tapered projection formed at the other end portion of said wiper actuator when said gate lever is actuated, thereby opening the coin return passage on said rear surface of said main plate.

6. A discriminator according to claim 5, wherein the other end portion of said wiper actuator is engaged with a rear wiper pivotally supported by said pin having one end fixed to said main plate, and said rear wiper is pivoted in the coin return passage on the rear surface of said main plate when said wiper actuator is slid upon actuation of said gate lever.

* * * * *